US009016478B2

(12) United States Patent
Böhnlein et al.

(10) Patent No.: US 9,016,478 B2
(45) Date of Patent: Apr. 28, 2015

(54) MAGNETIC DRUM SEPARATOR AND METHOD FOR OPERATION THEREOF

(75) Inventors: Rudolf Böhnlein, Bamberg (DE); Argun Gökpekin, Hammelburg (DE); Andreas Lekscha, Nürnberg (DE); Frank Schmidt, Nürnberg (DE); Ralph Oliver Schmidt, Fürth (DE); Bernd Zehentbauer, Erlangen (DE)

(73) Assignee: Siemens Aktiengesellschaft (DE)

( * ) Notice: Subject to any disclaimer, the term of this patent is extended or adjusted under 35 U.S.C. 154(b) by 0 days.

(21) Appl. No.: 14/236,800

(22) PCT Filed: Jul. 30, 2012

(86) PCT No.: PCT/EP2012/064864
§ 371 (c)(1),
(2), (4) Date: Apr. 17, 2014

(87) PCT Pub. No.: WO2013/020849
PCT Pub. Date: Feb. 14, 2013

(65) Prior Publication Data

US 2014/0216988 A1 Aug. 7, 2014

(30) Foreign Application Priority Data

Aug. 10, 2011 (EP) ..... 11177103

(51) Int. Cl.
*B03C 1/00* (2006.01)
*B03C 1/14* (2006.01)
*B03C 1/12* (2006.01)

(52) U.S. Cl.
CPC . *B03C 1/145* (2013.01); *B03C 1/12* (2013.01); *B03C 1/14* (2013.01); *B03C 2201/20* (2013.01); *B03C 2201/24* (2013.01)

(58) Field of Classification Search
USPC ..... 209/214, 219, 223.1, 223.2, 552, 938
See application file for complete search history.

(56) References Cited

U.S. PATENT DOCUMENTS 1,729,008 A * 9/1929 Osborne et al. ..... 209/223.2
2,785,801 A * 3/1957 Laurila ..... 209/223.1

(Continued)

FOREIGN PATENT DOCUMENTS

DE 1 583 773 A1 9/1970
DE 84 14 955 U1 6/1985

(Continued)

OTHER PUBLICATIONS

International Search Report dated Nov. 30, 2012 issued in corresponding International patent application No. PCT/EP2012/064864.

(Continued)

*Primary Examiner* — Terrell Matthews
(74) *Attorney, Agent, or Firm* — Ostrolenk Faber LLP

(57) ABSTRACT

A magnetic drum separator (2), with a drum (6) rotatable about a rotational axis (4), a magnet arrangement (10) of a plurality of magnets (12) arranged in the interior (8) of the drum (6), a separation zone (18) in the exterior space (14) of the drum (6); a feed material (22) flows through the separation zone (18) and is there separable with the aid of a magnetic field (26) generated by the magnet arrangement (10), into a waste stream (30) and a recyclable material stream (28). A relative position (R) of at least one of the magnets (12) relative to the rotational axis (4) can be varied. A nominal magnitude (S) for a process value (78) on the drum separator (2) that is influenced by the separation behavior (32) is specified. At least one measurement device (74) detects an actual magnitude (I) of the process value (78), and a controller (82), which changes the relative position (R) of the at least one of the magnets (12), whereby the actual magnitude (I) is controlled to approach the nominal magnitude (S).

17 Claims, 8 Drawing Sheets

(56) References Cited

U.S. PATENT DOCUMENTS

| | | | | |
|---|---|---|---|---|
| 3,430,870 | A | 3/1969 | Weston | |
| 7,841,474 | B2 | 11/2010 | Grey et al. | |
| 8,807,344 | B2 * | 8/2014 | Keaton et al. | 209/223.2 |
| 2011/0132192 | A1 | 6/2011 | Bates | |
| 2011/0163015 | A1 * | 7/2011 | Shuttleworth et al. | 209/223.2 |
| 2014/0216988 | A1 * | 8/2014 | Bohnlein et al. | 209/214 |

FOREIGN PATENT DOCUMENTS

| | | | |
|---|---|---|---|
| GB | 100063 | A | 5/1916 |
| GB | 152549 | A | 10/1920 |
| RU | 2 220 775 | C1 | 1/2004 |
| RU | 2 375 117 | C1 | 12/2009 |
| RU | 238 01 64 | C1 | 1/2010 |
| SU | 606624 | A1 | 5/1978 |
| WO | WO 98/19795 | A1 | 5/1998 |

OTHER PUBLICATIONS

Written Opinion dated Nov. 30, 2012 issued in corresponding International patent application No. PCT/EP2012/064864.

European Search Report dated Jan. 23, 2012 issued in corresponding European Patent Application No. EP 11 17 7103.

* cited by examiner

MAGNETIC DRUM SEPARATOR AND METHOD FOR OPERATION THEREOF

CROSS-REFERENCE TO RELATED APPLICATIONS

The present application is a 35 U.S.C. §§371 national phase conversion of PCT/EP2012/064864, filed Jul. 30, 2012, which claims priority of European Patent Application No. 11177103.6, filed Aug. 10, 2011, the contents of which are incorporated by reference herein. The PCT International Application was published in the German language.

FIELD OF THE INVENTION

The invention relates to a magnetic drum separator and a method for operation thereof.

TECHNICAL BACKGROUND

Magnetic separation is a method of separating materials which have different magnetic properties. This method is applied by means of a separator. The magnetic separators which are used in the ore preprocessing industry, above all in the case of ferromagnetic materials, are mostly magnetic drum separators. Drum separators exist in various forms of embodiment, e.g. drum separators which operate with the flow and against the flow. The drum separator separates out a material to be processed into a stream of useful materials and a stream of waste materials. In other words, using such separation processes, useful materials are to be separated from non-useful ones, as a stream of useful materials and a waste material stream. In particular in mining, weak-field drum separators are used for magnetite enrichment. This method or process, as applicable, can be realized using a constant or alternating magnetic field. For example, in the preparation of magnetite ores, permanent magnets are mostly used.

The drum of the drum separator is not itself magnetic. Within the drum there is a system of magnets which consists of permanent magnets or electromagnets. The drum represents the part of the separator which, in operation, is movable, namely rotates about its axis of rotation, and the position of the axis is fixed in space or location, as applicable. On the other hand, the system of magnets forms a part which is essentially unmovable.

The pipe material, as the material to be processed, is introduced into the separator in an upper or lower region of the rotating drum. In this case, for wet separation the material to be processed is deposited as a suspension, also called a slurry. The magnetic poles of the separator are distributed around the circumference of the drum, with defined spacings, or a defined geometry, as applicable. The geometric arrangement of the magnets determines the field geometry in the separation zone. The so-called gap size, that is the distance between the system of magnets and the material to be processed or the drum, as applicable, determines how the separator works, and has a decisive influence on the output streams emerging from the drum separator, namely the stream of waste materials and the stream of useful material. If the gap is too small, too much material will be attracted by the magnetic attractive force from the system of magnets, so that even grains with only a low ferro-magnetic content are attracted onto the drum wall, and pass into the stream of useful material. The selectivity of the separator is thereby limited, and the quality of the stream of useful material is then too low. On the other hand, if the gap is too large only very strongly magnetized particles will be carried along with the stream of useful material because of a high ferro-magnetic content in the particles, so that the throughput of the separator is limited. Useful material, i.e. for example magnetic material, then also passes into the stream of waste materials, which reduces the yield of useful material. In both cases, the specific energy consumption of the drum separator rises, in the first case mentioned above it rises additionally because more waste materials, e.g. low grade ore, are present in the stream of useful material and thus, for example, will be transported into a subsequent milling stage.

In a magnetic separator for ore preparation, it is not only the number of magnets but also the distance between the magnets which is an important constructional characteristic. The intent is to use the magnets and their spacing from each other, by repeated changing or by interruption of the magnetic field strength, and thus by changing the magnetic force on the iron particles toward the drum, to prevent the formation of agglomerations during the separation process along the direction of flow of the material to be separated, i.e. the sticking together or concretion of iron-containing rock and gangue in the slurry. As a geometric characteristic, the spacing of the magnets from one another combined with the above spacing gap between the system of magnets and the drum wall is thus adjusted for the relevant composition of the ore, the grain size or the particle distribution in the slurry, as applicable, the solid matter content in the slurry, and hence for the composition of the slurry. The separator concerned can thus only be optimally used for the particular conditions specified.

These facts result in the separator losing efficiency when there are changes in the properties of the material to be processed, e.g. the ore, and thus after a certain operating period no longer being optimally adjusted for the product quality, or the yield, which is to be achieved in the output streams. The magnetic separator does not react to changed properties in the input material, that is the material to be processed. Here, changed properties might for example be a changed ratio of magnetic ores to non-magnetic rock.

Specifically, the composition of the ore comprising the material to be processed may change due to inhomogeneities in the rock, or in the mineral composition of the area being mined. As a consequence the separation process, and thus the machine parameters for the magnetic drum separator, must be adapted in order to ensure a constant high-quality or improved quality from the separation process.

The usual forms of construction of drum separators use mainly systems of magnets with permanent magnets. The system of magnets in the drum separator is laid out and installed according to the particular separation task concerned, and the system of magnets is consequently permanently built into the magnetic drum separator. If there is a change in the composition of the ore comprising the material to be processed, a constructional change must be made to the magnetic drum separator. This is carried out with the drum separator shut down. No other form of change is possible. The separator is thus adjusted for a particular ore sample. A change in the composition of the ore or the grain size of the ore necessitates the shutting down of the separator and conversion measures on the set of magnets, that is the arrangement of the magnets.

Changes of this sort to the constructional layout cannot at present be carried out during ongoing operation of the drum separator. It must be halted, i.e. an operational shutdown must be carried out. A machine operator then makes the appropriate changes to the drum separator or system of magnets, as applicable. An adaptation of this sort to the magnetic drum separator is also described, in the sense that it is a manual regulatory action, as so-called open-loop regulation by the machine operator. Adaptations which are necessary are in this case initially recognized by the operator, and are then carried out on the machine by means of constructional modification actions while machine operations are shut down, e.g. the set of permanent magnets is modified.

A drum separator is known from U.S. Pat. No. 7,841,474 B2 in which a system of magnets in roller form lies against the inner wall of the rotating drum. The contact pressure of the magnetic roller together with the site of its contact on the drum can be adjusted by a change in the position of the magnetic roller with the machine shut down.

From RU 222 0775 C1 and RU 23 75 117 C1, drum separators are known in which each of the magnets of the magnet set can rotate about an axis which runs through the magnet concerned. In other words, the orientation of the magnetic field of an individual magnet, together with the strength and the profile of the resulting overall magnetic field, can be altered. The axes of rotation run parallel to the axis of rotation of the drum.

WO 1998 019 795 A1 discloses how to rotate magnetic rollers also about an axis which passes through them. Here again, the axis runs parallel to the axis of rotation of the drum.

From RU 238 01 64 C1, it is known how to change the angle of inclination of individual permanent magnets relative to one another. Here again, the magnets rotate about axes of rotation which run through themselves, or in their immediate neighborhood.

Also known is how the position of the system of magnets in the drum can be manually relocated—with the machine shut down—in the sense that it can be rotated in its entirety about the axis of rotation of the drum. In so doing, the distance between the system of magnets and the drum is not changed. In other words, in the interior of the drum the air gap between the system of magnets and the non-magnetic drum is constant, and with the available solutions it cannot be changed. Because the material which is to be separated, i.e. the material being processed, is located on the outer perimeter of the drum, the distance from the system of magnets to the material to be separated is thus also constant and can also not be changed.

US 2011163015 A1 discloses a magnetic drum separator with a drum which can rotate about the axis of rotation and with an arrangement of magnets, having a plurality of magnets, arranged in the interior space of the drum. The individual magnets are arranged on a plate, which can pivot so that the position of the magnets relative to the axis of rotation of the drum separator can be altered.

U.S. Pat. No. 1,729,008 A discloses a magnetic drum separator which has a rotatable drum with an arrangement of magnets incorporating electromagnets. The position of the electro-magnets can be altered relative to the axis of rotation of the drum.

U.S. Pat. No. 2,785,801 A specifies a magnetic drum separator which has, arranged on a frame, magnets the position of which relative to the axis of rotation of the drum separator can be altered by means of the frame, even while the drum separator is in operation.

SUMMARY OF THE INVENTION

The object of the invention is to provide a magnetic drum separator and a method of operating it which is an improvement by comparison with those in the prior art.

The object is achieved by a drum separator of the invention and a method of the invention.

The inventive magnetic drum separator has a drum which can rotate about an axis of rotation. Arranged in the interior space of the drum is an arrangement of magnets. The arrangement of magnets has a plurality of magnets. In the exterior space around the drum there is a separation zone. Materials to be processed can flow through the separation zone. In other words the materials to be processed are—e.g. due to the rotation of the drum—moved through the separation zone. In the separation zone, with the help of a magnetic field produced therein by means of the arrangement of magnets, the materials to be separated are separated, in accordance with a separation characteristic of the drum separator, into a waste material stream and a stream of useful material. The separation of the materials to be processed into a waste material stream and a stream of useful material is thus effected mainly by the influence or with the help of the arrangement of magnets or their configuration, as applicable.

In the case of at least one of the magnets, its position relative to the axis of rotation can be altered. In other words, the position of the magnet relative to the drum or to the separation zone, as applicable, is changed. This change of position is to be understood as such that, when the drum separator is in operation, the drum rotates but the system of magnets does not however rotate with it but is located in a position which is generally fixed, even though this can be altered. Thus a repositioning of this "fixed" relative position of the system of magnets means here a change between positions of the magnets, relative to the axis of rotation, which are different but each of which is to be regarded per se, in relation to the rotation of the drum, as a fixed location. In other words, a repositioning of this type causes different "fixed sites" of the system of magnets or of the magnets relative to the axis of rotation to vary.

The term "relative position" is here to be understood in the narrow sense, by contrast with a "location". A change of location would also include the spatial orientation or alignment of the magnets, which could mean for example a rotation about an axis which passes through the magnets themselves or in their immediate neighborhood. On the other hand, a change of position means an alteration of the distance from the magnets to the axis of rotation (and hence to the drum) and/or a change in the circumferential position relative to the axis of rotation, that is a change of position in the circumferential direction around the drum.

In accordance with the invention, it is possible to prescribe for the drum separator a set-point quantity, for a process value at the drum separator, which is affected by the separation characteristics. In addition, the drum separator has at least one measuring instrument, for determining an actual value of the process value, and a regulator by which it is possible to effect automatically a change in the relative position of at least one of the magnets, by which means the actual value can be regulated toward the set-point value.

The process value is a quantity which can be sensed in the drum separator, e.g. a measurable property of the useful material stream or waste stream. The process value is in turn affected by the adjustable parameter of the position of the magnets relative to the axis of rotation, because this in turn determines the separation characteristics and hence, for example, the properties of the useful material stream and the waste stream, in the form of the process value. This produces a regulation loop for the adjustment of the parameter, which works during the operation of the drum separator.

So if one makes use of certain properties of the waste stream (tailings) or the stream of useful materials (concentrate), by measuring the actual values of process values which are available therein, then one can balance these actual values against previously defined set-point values, and issue appropriate regulation instructions for parameters of the drum separator. Here, the measurements are made on-line, i.e. in ongoing operation. In so doing, use is made of causal relationships between the measured quantities, the parameters which can be influenced, i.e. the parameters of the separation process and the control variables, to the end that a regulation loop for automated adjustment of the machine parameters results. Here, possible measurement sites are, for example, the stream of useful material or the waste stream.

The measured quantities could be: measurement of the content of useful material, e.g. magnetite ore or iron and/or a measurement of selected non-useful elements. Examples which can be cited here are phosphorus or silicon oxide. This can be used for monitoring the maximum permissible content of non-useful materials. Here, measurement is only meaningful in the useful material stream. A further measured quantity is the distribution of particle sizes in the useful material or concentrate. In the case of permanent magnets, parameters which are available as control variables are, for example, the positions of the magnets relative to one another or to the drum.

It is thus possible to construct a regulation loop consisting of a set-point/actual value comparison for the measured quantities under consideration.

Suitable measurement methods or principles are, for example, X-ray fluorescence for measurement of the material composition or material concentration, laser diffraction for the measurement of particle sizes or the distribution of particle sizes. Ultrasound can be used for measuring particle sizes or the distribution of particle sizes and the concentration of solid matter.

For this type of regulation in terms of the product quality (grade) the regulation objective is, for example, to change the relative positions of the magnets, and thereby the separation process parameters which can be influenced, up to the point when a measured actual concentration of the useful material in the useful material stream corresponds to the set-point concentration of useful material. Conversely, it would be conceivable to alter the control variables, and thereby the separation process parameters which can be influenced, up to the point when the measured actual concentration of the non-useful material in the stream of useful material corresponds to the set-point concentration for the non-useful material.

A regulation objective can also be formulated in terms of the grade of the yield (recovery): in this case the control variables, and thereby the separation process parameters which can be influenced, are altered up to the point when the maximum possible yield of the useful material is reached. Here again, minimization of the quantity of useful materials in the waste stream is alternatively possible.

With this form of embodiment, an automated (closed loop) regulation system is specified for the drum separator, in terms of the system of permanent magnets or electro-magnets which can be used, which permits a reaction to the changed external conditions, in particular the composition of the ore in the material to be processed, or the characteristics of the slurry (e.g. distribution of particle sizes, solid matter content, proportion of magnetite in the solid matter), as appropriate. By this means the separation process can at any time be operated at its optimal working point.

Thus adaptation of the positions of the permanent magnets in a set of magnets relative to each other, or the position of the set of magnets relative to the separation zone, as applicable, is thus effected by a control loop using a set-point/actual comparison between a predefined value of the control variable and the measured actual value. Both the measurement of the actual value and the adaptation of the control variables are here effected during ongoing operation and thus, using a change in the separation process parameters which it is possible to influence, enable interruption-free adjustment of the machine parameters for the relevant composition of the ore in the material to be processed by the machine. In the control loop, the control variable influences the parameter of the separation process. This in turn influences the measured quantity.

The linking of the measurable regulation variable to the control variables to form a regulation loop enables the modification of the machine parameters to be carried out without interruption, with a shorter time delay. The machine works continuously at its optimum functioning point and by this means an optimal separation result is guaranteed even when the material to be processed has an ore or slurry composition which differs over time.

So the position of individual or multiple permanent magnets or of the complete set of permanent magnets, as appropriate, will preferably be regulated in relation to the walls of the drum for the purpose of operating at the relevant optimal operating point. The invention is based on the recognition that, in addition, automated repositioning of the set of magnets in accordance with a closed loop regulation logic brings substantial advantages.

Automated regulation for the purpose of adapting the magnetic field strength and field profile in the case of sets of permanent magnets involving also changes to the location of the permanent magnets—individually or collectively—relative to the drum walls is thus effected with the objective of operating the separator at the relevant optimum operating point regardless of the materials to be separated.

Hence, in a preferred form of embodiment, the process value is a process value for the waste and/or useful material stream. This is, for example, the so-called "recovery" value in the useful material stream. In another preferred form of embodiment, the process value is the concentration of a material in the useful material stream or the waste stream. This is, for example, the so-called "grade" value for the useful material stream.

The change to the relative position of a magnet takes place for an individual magnet, for several or for all of the magnets in the system of magnets. The relative position can be adjusted jointly for several or all of the magnets in the same way, or even individually and differently for individual magnets or groups of magnets. By the change in position it is possible to influence, for example, the magnetic field strength or field strength gradient produced by the magnets in the separation zone.

At least one of the magnets can be an electro-magnet. In the case of the electro-magnet, it is then also possible to influence in addition the electrical variables of the electro-magnet's supply, to alter the characteristics of the field in the separation zone. For example, the field strength, phase angle and frequency can be influenced by such quantities as the current, voltage or power, fed to the electro-magnet. So for electro-magnets alterations are made, for example, to the strength of the excitation current, phase angle or excitation frequency.

The invention produces an increased flexibility of the installed set of magnets in reacting to fluctuations in the material to be processed, and the possibility of closed loop control in the drum separator.

This gives the advantage that there is a resulting improvement and stabilization in the quality of the output material, i.e. the stream of useful material, in spite of fluctuations in the composition of the input stream. This produces a reduction in the relative energy consumption when considering the overall plant, of which the magnetic drum separator is a part, for example a pre-processing plant. Such a plant is used, for example in mining, to increase the concentration of a useful material in a material to be processed, in the form of a stream of useful material, in that unwanted parts of the material to be processed are sorted out into the waste stream. Thus, the application of the invention also increases the relative throughput of the drum separator.

The position changes have their effect on the magnetic field which is effective in the separation zone. In other words, with the aid of the invention a magnetic field which can be altered is implemented in the separation zone. This alteration enables the field to be set in such a way that the ferro-magnetic material, for example, can in any particular case be more reliably and more efficiently separated from non-magnetic material. The objective in this situation is to achieve a yield/product quality relationship which is at any time optimal, and/or higher selectivity, using a simple and low-cost method. In other words, the possibility is produced, in particular by influencing the system of magnets, for structuring the gap—even during ongoing operation—between the magnetic poles of the system of magnets and the non-magnetic drum, and hence also to the materials which are to be separated, variably, i.e. under the influence of parameters. These measures make it possible to set an optimal adjustment of the magnetic field strength, and thereby to achieve an optimal attractive force in the separation zone to get to an optimal working point, desired or defined by the operator, in terms of the yield and product quality.

By altering the parameter which specifies the relative position, the operator can set the relationship between the yield and selectivity of the drum separator without the need to make constructional alterations to the separator. The ability to change the configuration of the drum separator by means of the parameter is then an inherent feature of it, which is a part of its actual construction. The construction per se of the drum separator thus no longer needs to be fundamentally altered, it is only necessary to adjust the parameter.

Here, it is possible to alter the position of the individual magnets in a set of magnets relative to each other, e.g. their spacing. The magnet set itself can thus also be adjusted for different grades of milling or slurry compositions.

In order to be able to set the result of the separation for a magnetic separator in respect of the yield and the quality of the concentrate, it is necessary to modify either external parameters, e.g. the rate of through-flow, the solid matter content or the slurry density, or internal machine parameters such as the rate of rotation of the drum, the magnetic field strengths or the profile of the magnetic field. A known method is to adjust the external parameters manually or (semi-) automatically. However, in the case of the internal parameters there are, for sets of permanent magnets, in addition the inventive possibilities, i.e. in general a few further options for repositioning the (individual) permanent magnets relative to each other and relative to the drum wall—apart from the methods already mentioned above. So an adjustment of the magnets relative to the drum wall is effected.

Use of the invention achieves the ability to operate the separation process always at its optimal working point, in that the set of magnets located in the drum separator has a magnetic field profile which can be adjusted and repositioned appropriately for the material which is being processed. This is critical for the success of the separation.

The field profile is influenced not only by the positioning of the magnets but also by magnet-specific properties, such as for example the material used for the magnets and its residual magnetization.

A defined alteration—during operation—of the geometry of the system of magnets, e.g. the spacing of the magnets from each other, makes it possible to use a single separator more flexibly in respect of the slurry composition. A separation plant with the possibility of making such alterations can, without actual constructional modification to change its design, be adjusted or modified appropriately during ongoing operation, for changes in the grade of milling of the ore or the composition of the ore, as applicable.

In a preferred form of embodiment, the relative position of at least two of the magnets can be altered independently of each other. So the alteration can be effected for two or more of the magnets, or all of them, independently of each other. With appropriate interpretation, this also applies for further forms of embodiment below which refer to at least two magnets.

In one preferred form of embodiment, the relative position can be altered in the circumferential direction and/or the radial direction relative to the axis of rotation. Thus the angle of rotation of the magnet about the axis of rotation is altered. The radial distance of the magnet from the drum or its walls, or from its axis of rotation, as applicable, is then also altered.

In combination, movements can thus also effectively be made about an axis which runs parallel to the axis of rotation. However, this excludes the above-mentioned rotations of the magnet about itself, e.g. it is thus possible for all the magnets to be rotated jointly about an appropriate axis, while the alignment or positions of the magnets relative to each other remain otherwise unchanged. However, this changes the relative position of the entire arrangement of magnets with respect to the separation zone or drum, as applicable. In this situation, it is also possible for individual magnets to have different radial distances from the drum. For example, the distance, that is the air gap, between the system of magnets and the drum, and hence from the materials to be separated, is altered by raising the magnetic system radially away from the drum.

In a preferred form of embodiment, the distance of two of the magnets from one another is altered. In this case, the distance can be, for example, the length along an arc measured in the circumferential direction about the axis of rotation, which can thereby be altered. In other words, the spacing of the magnets or the distance between the centers of the poles (the so-called "pole pitch"), as applicable, which arises in the tangential or circumferential direction of the drum, is then reset.

In a preferred form of embodiment, the positions of at least two of the magnets relative to each other can only be altered together. In other words, in this case a synchronized repositioning of the magnets concerned takes place, although not necessarily in the same way or of the same nature for both. In a further preferred form of embodiment, at least two of the magnets are arranged on a rigid frame. Another relative position can then be altered, that is for example the radial distance, swivel angle or tilt of the frame relative to the axis of rotation. For example, the magnets can be arranged on the frame in the form of an arc segment of a circle. The frame is then, for example, mounted at one end so that it can rotate about a pivot axis parallel to the axis of rotation so that it can be repositioned. By this means, all the magnets on the frame can again be altered radially and in a circumferential direction with the change in the position of the frame, but also by rotation about an axis which is not the same as the axis of rotation but which again lies outside the magnets themselves.

In one variant of this form of embodiment, the position of at least one of the magnets can in addition be changed relative to the frame. Here too, the effective change in position is to be understood as such that, as above, it takes place relative to the axis of rotation, that is there is no rotation about the magnets themselves.

In another form of embodiment, one or more magnets are mounted on a rail so that they can move laterally, e.g. the rail runs concentrically relative to the axis of rotation. The movement of the magnets is then along a path concentric with the axis of rotation, i.e. at a constant distance from the drum. The movement thus takes place in the circumferential direction of the drum. Here too, the distance between individual magnets in the circumferential direction can again be kept the same or can be different. It is then the positional displacement along the rail which is altered. In other words there is, in this case, 1-dimensional guidance of the magnets on the rail. This rail too can be understood per se in the sense of the frame mentioned above, and its position is then also alterable.

In a further preferred form of embodiment, the drum separator incorporates a drive which effects an alteration in the relative position of at least one magnet. However, the drive can alternatively also act on at least two of the magnets jointly, e.g. the drive can also act to alter the location of a plurality of magnets jointly. In this case, a single drive alters for example all the distances between these magnets, or of the magnets from the drum, either by the same amount or proportionally, while it is also possible here that changes in position or geometry are effected that are entirely different, for example on a zoned basis. This will depend on the constructional form of the mechanical coupling between the drive and the movement of the magnets. In other words, it is possible in this way to effect the synchronized repositioning of several magnets.

For operation of the inventive drum separator in wet separation mode, in which a set-point quantity is issued for a process value of the drum separator which is affected by the separation characteristics, the inventive method achieves the object by the following steps:

- Input of a material to be processed, in the form of a suspension, into the separation zone in such a way that the suspension flows through the separation zone;
- Generation of a magnetic field by means of the arrangement of magnets;
- Separation of the suspension, as determined by a separation characteristic of the drum separator, into a waste stream and a useful material stream;
- Using at least one measuring instrument, determination of an actual value of the process value and compare the actual value with the set-point value;
- If there is a deviation between the actual value and the set-point value, use of the regulator to change the relative position of the at least one magnet in such a way that the actual value is regulated in toward the set-point value.

The method makes possible a particularly rapid separation process which is at any time optimal, since it is possible to react immediately and automatically even to fast-varying changes in respect of the material to be processed.

The simultaneous sensing of several process values of different types leads to a further improvement in the regulation process, because changes in the material to be processed or relating to the material to be processed, which may counteract each other, can be immediately recognized and appropriately handled in combination.

Here, it has proven worthwhile to measure the concentration of a material in the useful material stream or the waste stream, by means of the at least one measuring instrument, and to form the process value from the measured concentration of the material in the useful material or waste stream. In so doing, it has been found advantageous if the concentration which is measured is that of a material which corresponds to the solid matter in the suspension or to the useful material in the suspension. Concentration measurement of this type can be made simply and without complication using the current prior art, by X-ray fluorescence analysis.

Preferably, as an addition or alternative to this, the at least one measuring instrument will be used to measure a flow speed for the suspension, and the process value will be formed from the measured flow speed. Such a measurement of the flow speed can also be made relatively simply and cost-effectively. It is further of advantage to measure, in combination with or as an alternative to the measurements already cited, a density and/or a temperature of the suspension, by means of the at least one measuring instrument, and to form the process value from the measured density and/or temperature. In order to obtain specific statements about the density, a parallel measurement of the temperature of the suspension here is required. Measurements of this type can also be deployed cost-effectively and with little expenditure.

Alternatively or in combination with this, it is further of advantage to determine a particle shape and/or a distribution of the mean particle sizes for particles of solid matter in the suspension, by means of the at least one measuring instrument, and to form the process value from the measured particle shape and/or the distribution of the mean particle sizes.

BRIEF DESCRIPTION OF THE DRAWINGS

In further describing the invention, reference is made to the exemplary embodiments in the drawings. These show, in each case as a schematic sketch.

DESCRIPTION OF EMBODIMENTS

Figure 1:
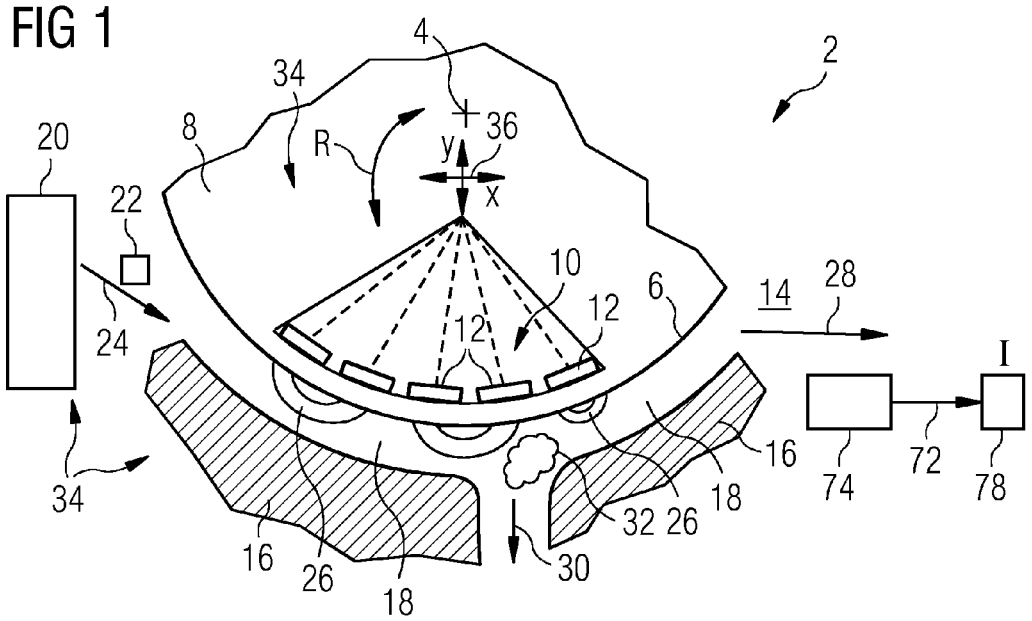
FIG. 1 a magnetic drum separator.

FIG. 1 shows a drum separator 2. This incorporates a drum 6 which can rotate about an axis of rotation 4. In an interior space 8 in the drum 6 there is an arrangement of magnets 10, which incorporates a plurality of magnets 12. The arrangement of magnets 10 is affixed so that its location relative to the axis of rotation 4 can be altered. More precisely, the arrangement of magnets 10 generally remains in the place shown in FIG. 1 whereas the drum 6 turns about the axis of rotation 4. However, during repositioning processes in the drum separator 2, which take place comparatively rarely relative to the rotation of the drum, the arrangement of magnets 10 or the magnets 12, as appropriate, also moves briefly relative to the axis of rotation 4. In any case, in this context this means that the arrangement of magnets 10 does not rotate continuously with the drum 6.

In an exterior space 14 outside the drum 6 there is a machine bed 16. Located or enclosed between the machine bed 16 and the drum 6 is a separation zone 18. In other words, the separation zone 18 refers to the space lying between the machine bed 16 and the drum 6. The drum separator 2 incorporates in addition a storage facility 20, which feeds material to be processed 22 into the separation zone 18, in the direction of the arrow 24. With the drum 6 rotating, a separation process is now effected by a magnetic field 26 produced in the separation zone 18 by the arrangement of magnets 10, as a result of which material to be processed 22, which is flowing in the direction of the arrow 24, is separated into a stream of useful material 28, shown by an arrow, and a stream of waste material 30, also indicated by an arrow.

The drum 6 or its movement, the configuration of the machine bed 16 or the separation zone 18, together with the arrangement of magnets 10 or the magnetic field 26 which is produced, determine the separation characteristics 32 of the drum separator 2, which is shown symbolically and the expression of which is the portions of the material to be processed 22 which pass, by amount and concentration, into the useful material stream 28 and which pass into the waste stream 30.

All the parts of the drum separator 2 which have just been mentioned can be altered in terms of various parameters 34. In FIG. 1, the parameters 34 are only symbolically shown. These parameters 34 all influence the separation characteristics 32. These parameters 34 can be altered during the operation of the drum separator 2, in particular while the material to be processed 22 is being fed in along the arrow 24 and during rotation of the drum 6 about the axis of rotation 4. Examples of parameters 34 which can be altered, together with their variation, are explained in full below:

In accordance with the invention, a parameter 34 is varied, as indicated in FIG. 1 by two double arrows 36. In this case, the parameter 34 alters the relative position R concerned of the arrangement of magnets 10 relative to the axis of rotation 4. This can be done during ongoing operation. As the parameter 34, here it is the x- or y-positions of the complete arrangement of magnets 10 which is altered, in each case in a direction perpendicular to the axis of rotation 4. By this means, the magnetic field 26 in the separation zone 18, and hence the separation characteristics 32, are also altered.

Figure 2:
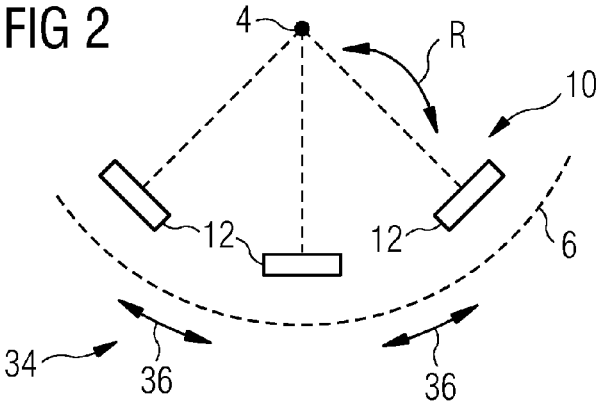
FIG. 2-3 alterable parameters for the arrangement of magnets in FIG. 1.
Figure 3:
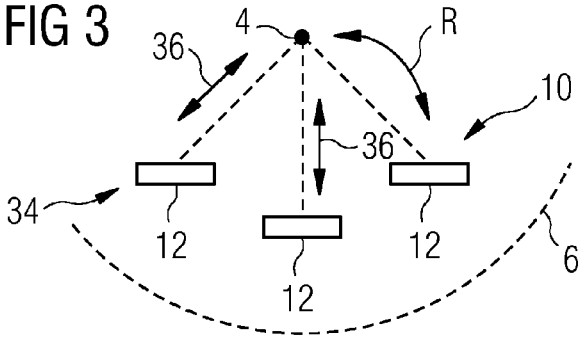

FIG. 2 and FIG. 3 show further inventive variants for the parameter 34, for altering the relative position R and changing this also alters the magnetic field 26 in the separation zone 18. In one variant, as shown in FIG. 2, the relevant distances between individual magnets 12 in the arrangement of magnets 10 is varied along the double arrow 36. So their spacing varies in a direction roughly tangential to the drum 6. In a variant in FIG. 3 on the other hand the parameter 34 which is altered is the radial distance between individual magnets 12 in the arrangement of magnets 10 and the drum 6, again along the double arrow 36.

Figure 4:
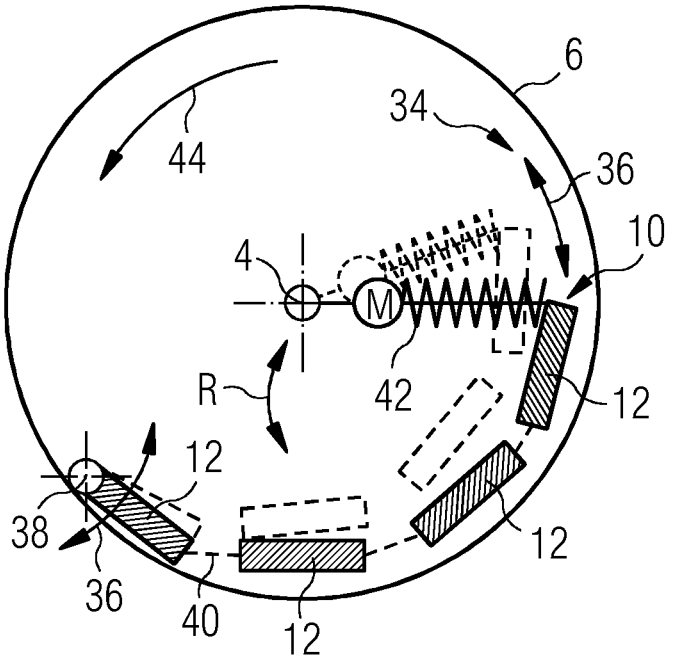
FIG. 4-5 alterable parameters for an alternative arrangement of magnets.
Figure 5:
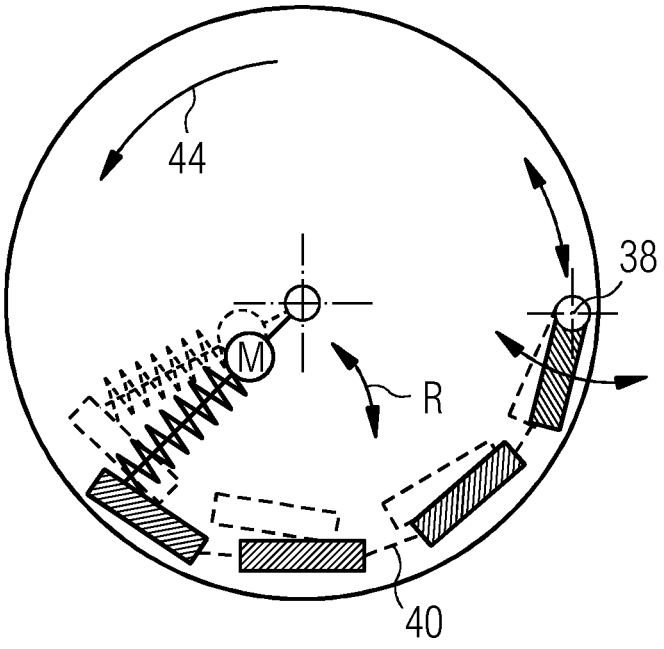

FIG. 4 and FIG. 5 show another form of embodiment in accordance with the invention for parameters 34 which can be altered for the purpose of changing the relative location R. Here, as in FIG. 1, the entire arrangement of magnets 10 can be driven along the double arrow 36 in a circumferential direction about the axis of rotation 4. In this exemplary embodiment, each of the magnets 12 is fixed onto a rigid frame 40, represented symbolically by dots. The entire frame 40 is mounted so that it can rotate, on an axis 38 which runs parallel to the axis of rotation 4, but which here does not coincide with the latter. The angle of pivoting about the axis 38 of the entire frame 40 represents a further degree of freedom in the form of a parameter 34 which can be influenced, again shown by a double arrow 36. The parameter 34 is a further position of the frame 40 relative to the axis of rotation 4.

The corresponding movement is effected in FIG. 4 by a drive 42, one side of which engages with the axis of rotation 4 and the other with the end of the frame 40 which is away from the axis 38. Here, actuation of the drive 42 effects a combined repositioning of the positions R of all the magnets 12 relative to the drum 6. In this case, the parameter 34 is the setting of the drive. FIG. 4 shows two situations, each with different parameters 34 or relative positions R, as solid lines and dashed lines respectively. The solid lines show a basic setting of the arrangement of magnets 10 and the dashed lines a positional setting of the arrangement of magnets 10 corresponding to an altered parameter 34. In other words, the pivoting about the axis 38 effects an adjustment of the distance setting between the magnets 12 and the separation zone 18.

An arrow 44 indicates the direction of rotation of the drum 6 during separation operations. The situations in FIG. 4 and FIG. 5 show two different forms of embodiment of the invention, in which the frame 40 is mounted on the axis 38 at its one end or its other end, relative to the direction of rotation of the drum. A consequence of this is that when the parameter 34 concerned is altered for the purpose of pivoting the frame 40 about the axis 38, different geometries result for the magnetic field 26 in the separation zone 18. In one case the result, looking in the direction of rotation of the drum 6 shown by the arrow 44, is an increasing distance between the magnets 10 and the drum 6, and in one case a decreasing distance. Correspondingly, fundamentally altered separation characteristics then result in the drum separator 2.

So in FIG. 4 and FIG. 5, an alteration is effected in the distance between the (permanent) magnets 12 and the drum 6 or the drum wall, as applicable. This distance increases or decreases steadily around the circumference of the drum. So between the set of magnets and the drum wall distances which, looking in the direction of rotation of the drum 6, increase or decrease in a wedge-like manner are implemented.

Figure 6:
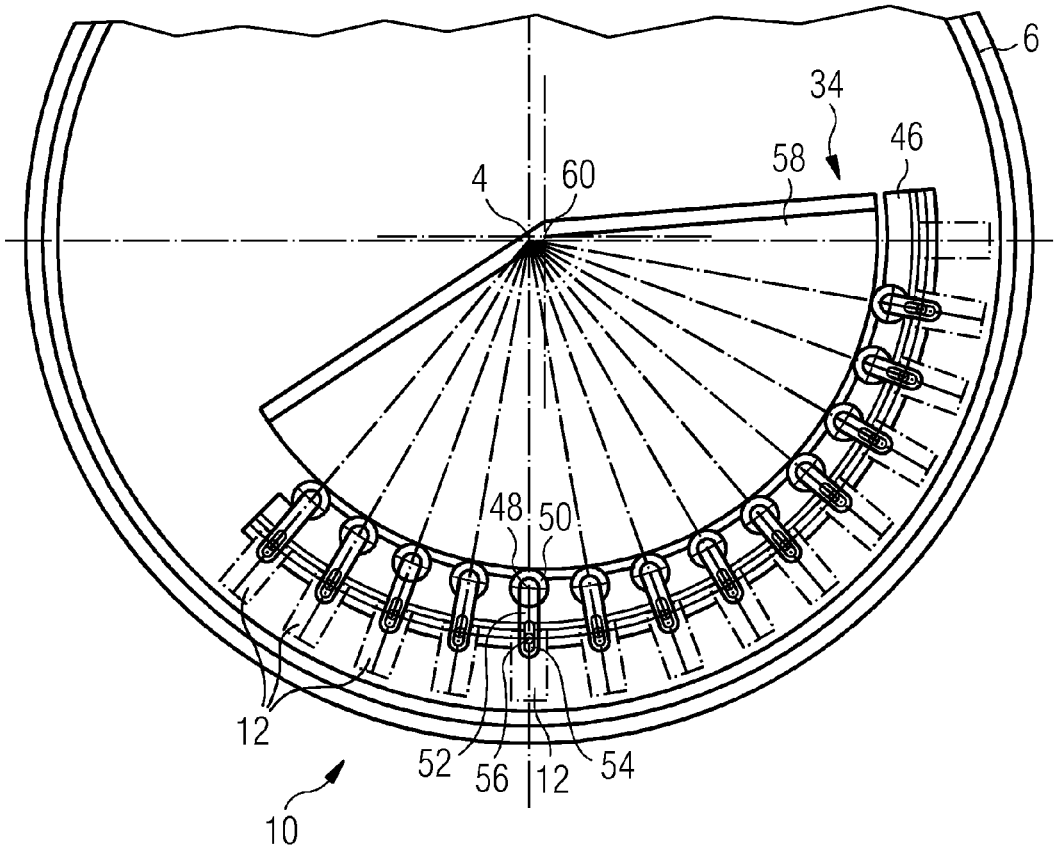
FIG. 6-9 further alterable parameters for an alternative arrangement of magnets, FIG. 10 a block diagram of a separation process, FIG. 11 a block diagram of a regulation process, FIG. 12 a relationship between "grade" and "recovery", FIG. 13 alterable parameters of an alternative arrangement of magnets.

FIG. 6 shows another form of embodiment of a drum separator 2 or arrangement of magnets 10, as applicable. Here, the individual magnets 12 are mounted on a rail 46 so that they can be displaced in a circumferential direction about the axis of rotation 4 in order to change their relative positions R. Apart from this, each of the magnets 12 is linked to a gearwheel 50 which is mounted on the rail 46 so that it can rotate about an axis 48. A crank 52 with a slot 54 is arranged rigidly on each gearwheel 50 so that it rotates with the latter. A pin 56 which is joined to the magnet 12 engages in the slot 54. The distance between the pin 56 concerned and the axis 48 increases from one magnet position to the next magnet position, for which reason each of the cranks 52 also gets longer.

An alteration in the arrangement of the magnets 10 is effected in that all the gearwheels 50 are in turn linked to a toothed drive sheave 58, which engages simultaneously with all the gearwheels 50. The drive sheave 58 is mounted so that it can rotate about a drive axis 60, which lies parallel to the axis of rotation 4 but is offset eccentrically from it. If the drive sheave 58 is turned about the drive axis 60, all the gearwheels 50 are moved or rotated through the same angle of rotation, and the cranks 52 pivot correspondingly. The magnets 12 are then displaced about the axis of rotation 4 along the rail 46 but by different distances and hence different angular differences, due to their different effective lever lengths from the pins 56. So their spacings in the circumferential direction alter by different amounts. In this case, the angular setting of the drive sheave 58 about the axis of rotation 60 represents a parameter 34.

Figure 7:
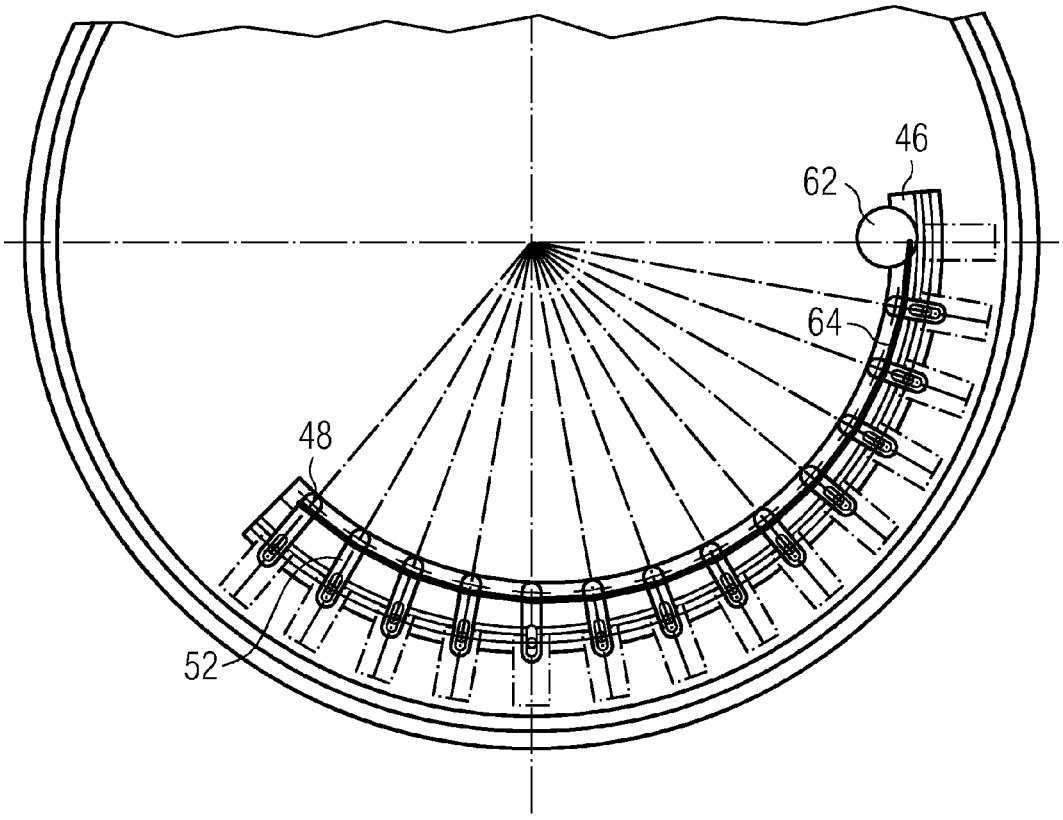
Figure 8:
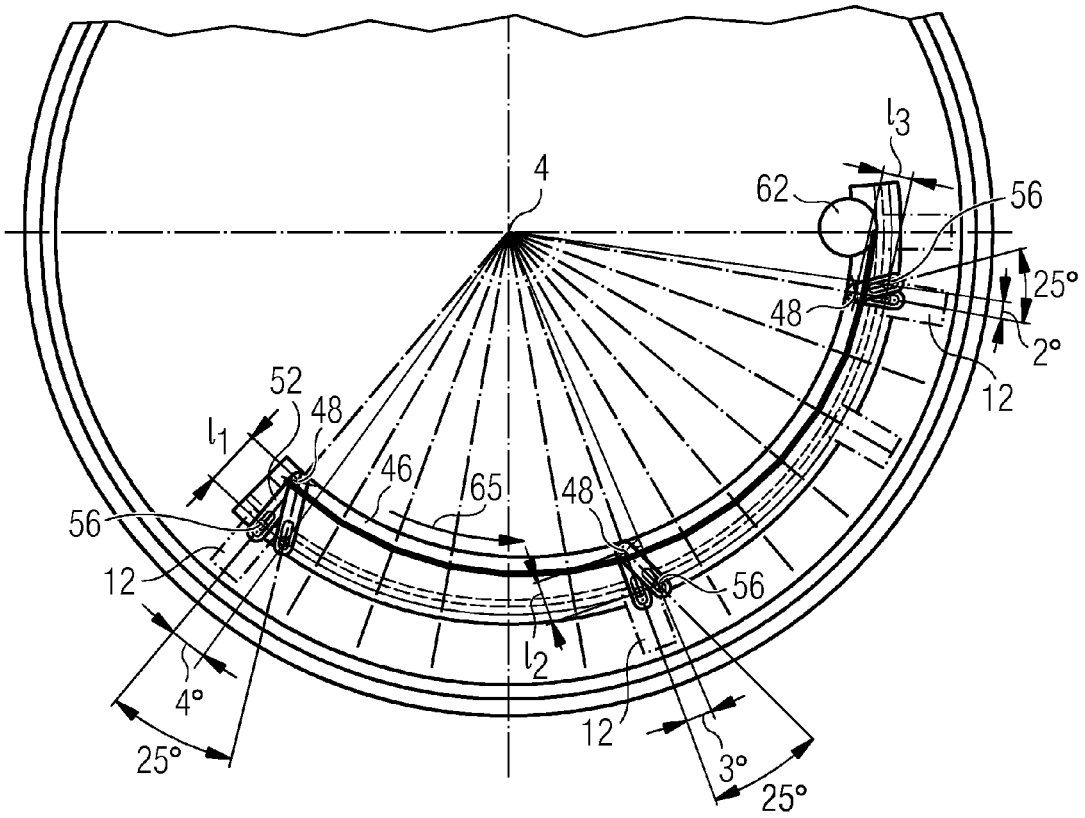

FIG. 7 and FIG. 8 show a form of embodiment which is similar in principle to but alternative to FIG. 6. The cranks 52 are again all mounted on the rail 46 so that they can turn by means of the relevant axes 48. However, the combination of gearwheels 50 and drive sheave 58 is here replaced by a drive 62 which works on a connecting rod 64, which in turn is linked to each crank 52. A displacement of the connecting rod 64 in the circumferential direction about the axis of rotation 4 therefore also works on all the cranks 52, in the same way as in FIG. 6.

FIG. 7 shows the connecting rod 64 and, by way of example, three of the cranks 52, in a basic position. In FIG. 8, the connecting rod 64 has been displaced in the direction of the arrow 65. The three cranks 52 shown by way of example therefore each rotate about their axes of rotation 48 by the same angle of—in the example—25°. Because each of the lengths between the axis 48 and the pin 56 is different, $l_1>l_2>l_3$, the magnets 12 concerned are displaced by different distances along the rail 46. So the result is an angular repositioning of the magnets 12 relative to the axis of rotation 4 by 4°, 3° and 2°.

Figure 9:
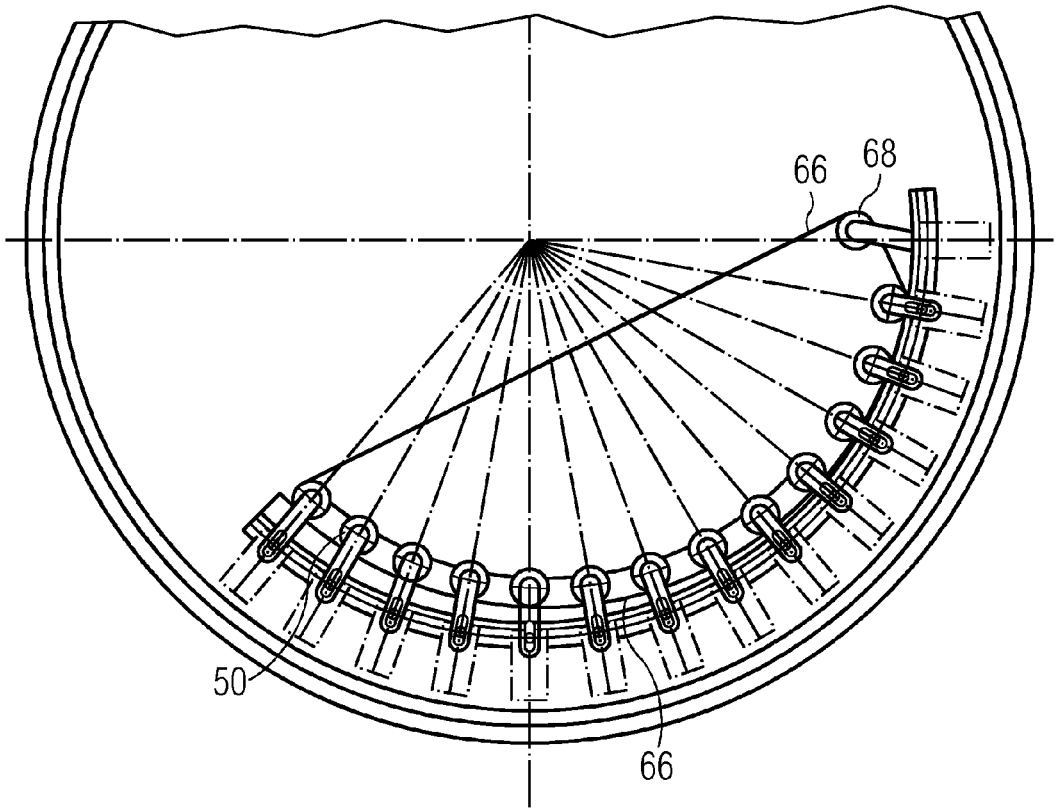

The form of embodiment as shown in FIG. 9 also corresponds essentially to that in FIG. 6, where in this case however, the gearwheels 50 are retained. The only change is that the drive sheave 58 is replaced by a chain 66 which engages jointly with all the gearwheels, and which is driven by a drive 68.

Thus in FIGS. 6-9 there is an alteration in the distances between the individual (permanent) magnets 12 in the circumferential direction of the drum 6.

Figure 10:
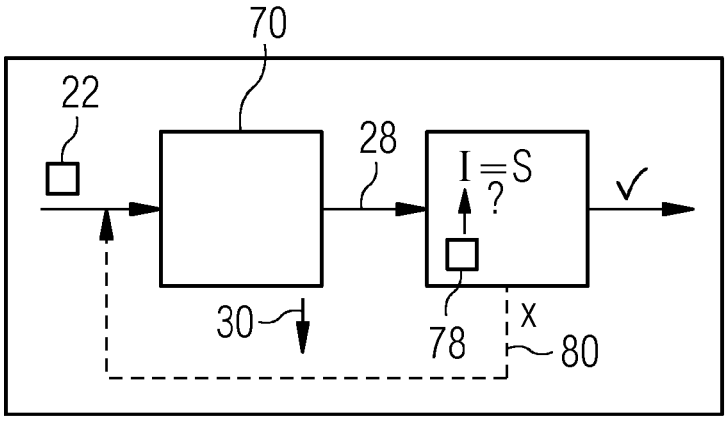

FIG. 10 shows schematically the ore preparation process in a drum separator as in FIG. 1. The material to be processed 22 is fed to the actual separation process 70, which takes place in the separation zone 18. As determined by the separation characteristics 32, the material to be processed 22 is divided into the useful material stream 28 and the waste stream 30. A concentration analysis 72 now takes place (in this connection see also FIG. 1), in which an actual value I is determined for a process value 78 measured with a measuring instrument 74. If the result of the comparison is satisfactory, no further action is taken. If a substantial deviation between the set-point value S and the actual value I is detected, a modification of the control variables, in the form of the process parameters 34, takes place along the arrow 80 i.e. a modification as necessary of the relative positions R of the magnets 12 in the separation process 70.

Figure 11:
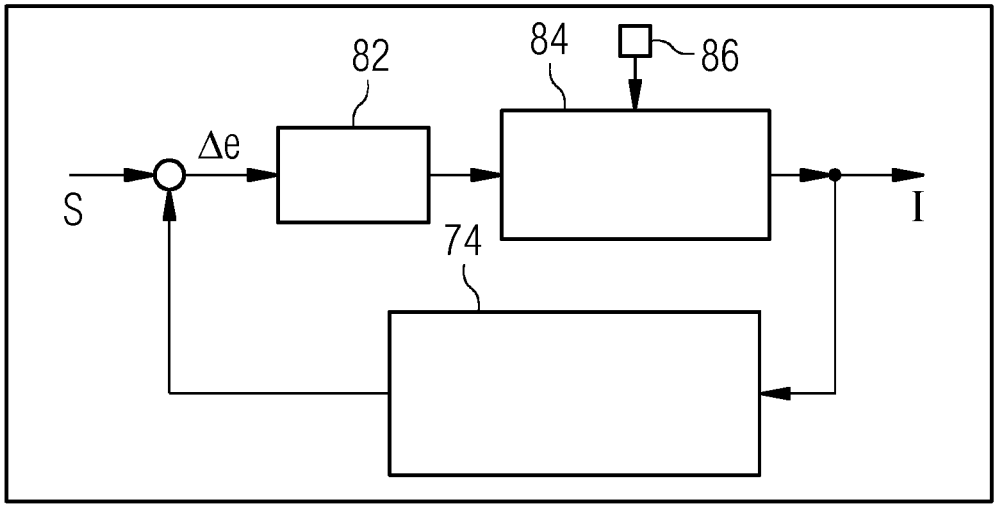

FIG. 11 then shows a schematic diagram of a regulating circuit for the separation process 70, to which the set-point value S is fed as the input quantity, e.g. the iron concentration as a percentage or a gangue concentration as a percentage. The set-point value S is compared with the result of the measurement by the measuring instrument 74, that is the process value 78. The error $\Delta e$ thus calculated is fed to a regulator 82. In a control system 84, which serves to adapt the control variables, that is the process parameters 34 in the form of the relative positions R, a modifying variable 86 also exerts an effect, from which the result is the actual value I.

The process value 78 is, for example, the concentration of iron as a % in the useful material stream 28. The modifying variable 86 could be the grain size or alternatively, or additionally, the proportion of gangue particles or the degree of digestion. The actual value I then stands for the actual iron content in the useful material stream 28. The process value 78 is set by the separation characteristics 32 or is determined by it, and hence is a measure of the separation characteristics 32. The separation characteristics 32 can be set by the parameter 34 in the form of the relative positions R, which then works through in the process value 78.

If the magnets 12 are engineered as electro-magnets, it is possible to a certain degree to adjust the system of electro-magnets, that is the arrangement of magnets 10, for the separation task, i.e. the separation characteristics 32, by setting the current I flowing through the electro-magnets. The basis for this is the relationship $B=\mu_0\mu_r I\, n/l$, where the current strength I can be adjusted either manually or equally by automated means from outside the machine, i.e. the drum separator 2 or the drum 6, as appropriate. Further repositioning measures in respect of the relative positions R can nevertheless—as explained above—again be necessary in the case of electro-magnets 12, in order to permit full and flexible adjustments for the materials to be separated. These would include, for example, the above-mentioned repositioning of the spacing between the electro-magnets 12.

Permanent magnets 12 do not have the property of an underlying current strength I which can be modified to change the field strength, so the magnetic field can only be effected by the displacement mentioned above, that is a change in the relative position R of the (individual) permanent magnets 12 within the drum 6 in a radial and/or tangential direction relative to the axis of rotation 4. Here, in an advantageous form of embodiment, this displacement should also not take place manually but rather in a regulated or automated way.

By the repositioning of the magnets 12 relative to the drum walls of the drum 6, it is possible to alter the magnetic field strengths and the magnetic flux density of the magnetic field 26 which exists in the separation zone 18. This determines the two essential quantities which characterize the separation effectiveness:

level of the yield ("Recovery r"):

This is the proportion of a material in the input mass flow, that is the material to be processed 22, which is separated out into the useful material stream 28 ("concentrate"). For example, suppose there is an input of 100 t of iron, 68 t of iron are then left in the concentrate stream 28. The yield/recovery then amounts to r=68/100=68%.

Iron content in the concentrate ("grade of concentrate g", "enrichment", "concentrate quality"):

For the desired useful material, this corresponds to the useful material content in the concentrate stream, i.e. in the useful material stream 28. For example, g=60% of the quantity of concentrate then consists of iron.

Figure 12:
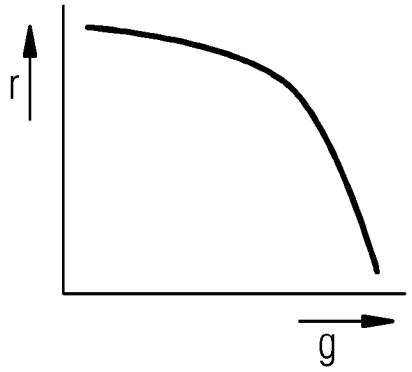

FIG. 12 shows that there is a negative correlation between the grade of concentrate g and the recovery r. Each separation process must be adjusted to meet a desired separation objective, which consists of a combination of a defined grade g and a defined recovery r.

If the input stream (material to be processed 22) which is being fed into the separation plant, that is the drum separator 2, now changes due to a change in the mineralogical composition of the deposits or its make-up, then in order to keep the same grade-recovery ratio it may be necessary to adjust appropriately the magnet set, that is the arrangement of the magnets 10. This adjustment is effected as an option which is additional, or indeed even substitutional, to the previously known alteration of other process parameters, such as slurry density, through-flow or an exchanged magnet set.

Here, the grade/recovery levels are influenced, as well as by the rate of through-flow and the solid matter content in the slurry, to a substantial extent by the magnetic attraction force working on the ferro-/ferri-magnetic iron particles, that is by the magnetic field 26 in the separation zone 18. This is itself in turn influenced by the magnetic field strength/flux density, magnetic conductivity or susceptibility of the iron, the "prehistory" of its magnetization, particle volumes, mineralogical composition of the particles (iron content), particle shape, the temperature and the distance between the magnets 12.

For the regulation method mentioned above the table below shows the conceivable repositionings of the magnet set and their causal relationships. Here, each causal relationship is considered in isolation, the table below makes no statements about the combined modification of several input parameters being changed simultaneously:

| | Change in the input | Machine modification to maintain a constant separation result |
|---|---|---|
| 1 | Through-flow increases/through-flow speed of the slurry | hydrodynamic resistance increases<br>magnetic force on the particles must increase<br>magnet set must be driven to a point nearer the drum wall, or<br>the distances between the magnets must be reduced |
| 2 | Solid matter content drops/ slurry density drops | lower slurry density<br>lower viscosity of the slurry and reduced agglomeration effect due to less magnetite particles/proportion concentrate becomes purer<br>magnet set must be driven further away from the drum wall |
| 3 | Mean particle size drops | hydrodynamic resistance drops<br>magnetic force on the particles must be reduced<br>magnet set must be driven further away from the drum wall or<br>the distances between the magnets must be increased |
| 4 | Iron content in the particles drops | magnetic susceptibility/conductivity of the particle drops<br>magnetic force on particles drops<br>magnet set must be driven to a point nearer the drum wall, or<br>the distances between the magnets must be reduced |
| 5 | Particle shape (increase in the ratio of the axes) | reduction in the demagnetizing factor resulting field which works on the particles increases<br>magnet set must be driven further away from the drum wall or<br>the distances between the magnets must be increased |
| 6 | Temperature of the slurry drops | susceptibility increases<br>magnetic force on particles increases<br>magnet set must be driven further away from the drum wall or<br>the distances between the magnets must be increased |

If there is an alteration in the input which is opposite to the alteration in the input described above, the resulting machine modification which must be carried out is in each case correspondingly opposite to that of the above description.

Figure 13:
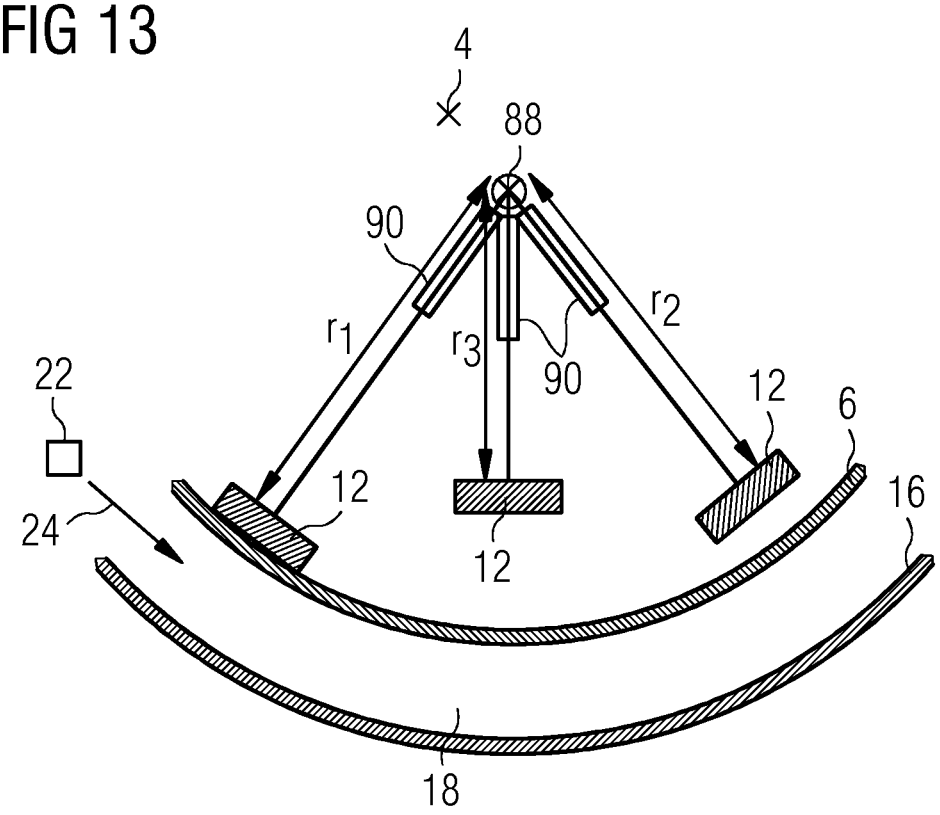

FIG. 13 shows a further alternative to the change in the position R of the magnets 12 relative to the axis of rotation 4. Here, the magnets are moved in relation to an axis 88 which is parallel to the axis of rotation 4. Each magnet 12 is distinguished by the ability to be repositioned individually in a radial direction. For the radii to the axis of rotation 88: r1, r2 and r3 it is the case that any pair of them can be different, where it is the case for the situation shown that: r1>r2>r3. The radial displacement is effected by electro-mechanical actuators 90. The bed of the machine 16 is here constructed as a separator trough. Here again, the result is the setting of a particular magnetic field profile. The individual positioning of all the magnets 12 enables a more precise influence to be exerted over the magnetic field profile than in the case of synchronized repositioning of the magnets 12.

The invention claimed is:

1. A magnetic drum separator comprising:

a drum which is rotatable about an axis of rotation;

an interior space in the drum;

an arrangement of magnets having a plurality of the magnets arranged within the interior space in the drum;

a separation zone located in an exterior space outside the drum, and configured for material to be processed to flow through the separation zone;

the arrangement of magnets producing a magnetic field operable for separating the material to be processed into a waste stream and a useful material stream in the separation zone in accordance with separation characteristics of the drum separator;

a relative position of at least one of the magnets relative to the drum axis of rotation can be altered;

a set-point value can be issued for a process value on the drum separator, wherein the process value is influenced by the separation characteristics;

at least one measuring instrument for determining an actual value of the process value; and a regulator configured for automatically changing the relative position of the at least one of the magnets automatically in a manner to regulate the actual value toward the set-point value.

2. The drum separator as claimed in claim 1, in which the relative position of at least two of the magnets can be altered independently of each other.

3. The drum separator as claimed in claim 1, in which the relative position of the one of the magnets can be altered in the circumferential direction of the drum and/or in the radial direction of the drum relative to the axis of rotation of the drum.

4. The drum separator as claimed in claim 1, further comprising a device to alter a distance between at least two of the magnets.

5. The drum separator as claimed in claim 1, further comprising a device to alter the relative positions of at least two of the magnets only in dependence on each other.

6. The drum separator as claimed in claim 1, further comprising a rigid frame on which at least two of the magnets are arranged; and the frame having relative positions relative to the axis of rotation of the drum, for altering the relative positions of the at least two magnets.

7. The drum separator as claimed in claim 6, further comprising the relative position of the at least one of the magnets relative to the frame can be altered.

8. The drum separator as claimed in claim 1, further comprising a rail on which the magnet is mounted and in such a way that the at least one of the magnets may be displaced along the rail.

9. The drum separator as claimed in claim 1, further comprising a drive connected and configured to effect a joint alteration in the relative positions of at least two of the magnets.

10. The drum separator as claimed in claim 1, wherein the process value is a process value of the waste stream or of the useful material stream.

11. The drum separator as claimed in claim 1, wherein the process value is a concentration of a material in the useful material stream or in the waste stream.

12. A method for operating a drum separator as claimed in claim 1 in a wet separation mode, comprising:

issuing a set-point value for a process value on the drum separator wherein the separator is influenced by the separation characteristics of the drum separator, the method having the following steps:

introducing a material to be separated, which material is in the form of a suspension, into the separation zone, in a manner such that the suspension flows through the separation zone;

producing a magnetic field at the separation zone by the arrangement of magnets;

separating the suspension in accordance with the separation characteristics of the drum separator into a waste material stream and a useful material stream;

determining an actual value of the process value, using the at least one measuring instrument, and comparing the actual value with the set-point value;

wherein if the actual value deviates from the set-point value, operating the regulator to change the relative position of the at least one of the magnets in such a way that the actual value is regulated toward the set-point value.

13. The method as claimed in claim 12, further comprising, measuring the concentration of a material in the useful material stream or in the waste stream by the at least one measuring instrument, and forming the process value from the measured concentration of the material in the useful material stream or in the waste material stream.

14. The method as claimed in claim 13, wherein the concentration which is measured is that of the material which corresponds to the solid matter in the suspension or the useful material in the suspension.

15. The method as claimed in claim 12, further comprising measuring a flow velocity of the suspension by the at least one measuring instrument, and forming the process value from the measured flow velocity.

16. The method as claimed in claim 12, further comprising measuring a density and/or a temperature of the suspension by the at least one measuring instrument and forming the process value from the measured density and/or temperature.

17. The method as claimed in claim 12, further comprising determining a particle shape and/or a mean particle size distribution for the solid matter particles in the suspension by the at least one measuring instrument and forming the process value from the measured particle shape and/or mean particle size distribution.

* * * * *